US011548022B2

(12) United States Patent
Burmann et al.

(10) Patent No.: US 11,548,022 B2
(45) Date of Patent: Jan. 10, 2023

(54) DISPENSING DEVICE AND DISPENSER

(71) Applicant: APTAR DORTMUND GMBH, Dortmund (DE)

(72) Inventors: Guido Burmann, Dortmund (DE); Swen Barenhoff, Dortmund (DE); Bernhard Jasper, Waltrop (DE)

(73) Assignee: APTAR DORTMUND GMBH, Dortmund (DE)

( * ) Notice: Subject to any disclaimer, the term of this patent is extended or adjusted under 35 U.S.C. 154(b) by 0 days.

(21) Appl. No.: 16/976,831

(22) PCT Filed: Mar. 14, 2019

(86) PCT No.: PCT/EP2019/056488
§ 371 (c)(1),
(2) Date: Aug. 31, 2020

(87) PCT Pub. No.: WO2019/175349
PCT Pub. Date: Sep. 19, 2019

(65) Prior Publication Data

US 2021/0001361 A1 Jan. 7, 2021

(30) Foreign Application Priority Data

Mar. 15, 2018 (DE) ..... 10 2018 002 101.8

(51) Int. Cl.
*B05B 11/00* (2006.01)
*A45D 34/00* (2006.01)

(52) U.S. Cl.
CPC ..... *B05B 11/3035* (2013.01); *B05B 11/3059* (2013.01); *A45D 34/00* (2013.01);
(Continued)

(58) Field of Classification Search
CPC ..... B05B 11/3035; B05B 11/3039; B05B 11/0032; B05B 11/3069
See application file for complete search history.

(56) References Cited

U.S. PATENT DOCUMENTS 3,840,157 A 10/1974 Hellenkamp
4,220,264 A 9/1980 Gamadia
(Continued)

FOREIGN PATENT DOCUMENTS

CA 2167799 A1 2/1995
CN 101244410 A 8/2008
(Continued)

OTHER PUBLICATIONS

International Search Report for International Application No. PCT/EP2019/056488, dated Jul. 4, 2019.
(Continued)

*Primary Examiner* — Jeremy Carroll
(74) *Attorney, Agent, or Firm* — Jason H. Vick; Sheridan Ross, PC

(57) ABSTRACT

The invention relates to a dispensing device (2) for dispensing a fluid. The dispensing device (2) comprises a pump device (4) for conveying the fluid from a container (3). The pump device (4) can be actuated preferably by means of an actuating lever (21) of the dispensing device (2) and/or is formed by a flexible bellows (5). Furthermore, a dispenser (1) for dispensing a fluid with a container (3) and a dispensing device (2) is disclosed.

18 Claims, 10 Drawing Sheets

Figure 1:
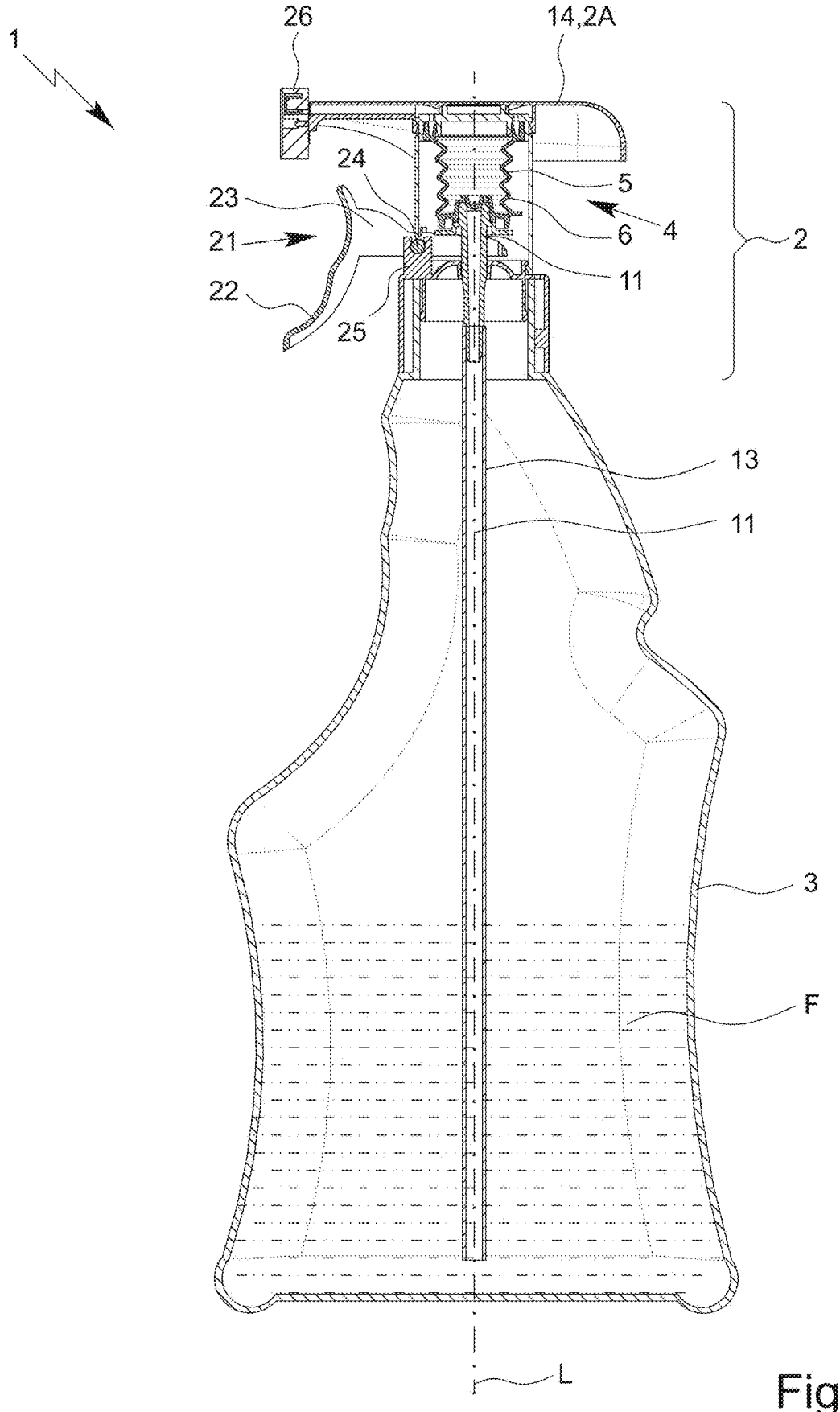

(52) U.S. Cl.
CPC ..... *A45D 2200/054* (2013.01); *B05B 11/0032* (2013.01); *B05B 11/3069* (2013.01)

(56) References Cited

U.S. PATENT DOCUMENTS

| | | | | |
|---|---|---|---|---|
| 4,278,187 | A | 7/1981 | Luedtke | |
| 4,506,805 | A * | 3/1985 | Marcon | B05B 11/3057 222/153.13 |
| 4,558,821 | A * | 12/1985 | Tada | B05B 11/3012 239/333 |
| 4,946,074 | A * | 8/1990 | Grogan | B05B 11/0032 222/153.13 |
| 4,979,646 | A * | 12/1990 | Andris | B05B 11/3081 222/207 |
| 5,114,052 | A * | 5/1992 | Tiramani | B05B 11/0064 222/207 |
| 5,238,156 | A | 8/1993 | Andris | |
| 5,303,867 | A * | 4/1994 | Peterson | B05B 11/0044 222/207 |
| 5,560,545 | A * | 10/1996 | Grogan | B05B 11/3074 239/304 |
| 5,561,901 | A | 10/1996 | Stahley et al. | |
| 5,722,569 | A | 3/1998 | Foster | |
| 5,823,396 | A * | 10/1998 | Vollmerhaus | B05B 11/3059 222/153.13 |
| 5,839,621 | A * | 11/1998 | Tada | B05B 11/3059 222/384 |
| 6,006,950 | A * | 12/1999 | Watanabe | B05B 11/0029 222/153.13 |
| 6,279,784 | B1 | 8/2001 | O'Neill | |
| 6,286,723 | B1 * | 9/2001 | Sweeton | B05B 11/3057 222/153.13 |
| 6,548,770 | B1 | 4/2003 | Stewart et al. | |
| 6,669,058 | B1 * | 12/2003 | Sweeton | B05B 11/3057 222/153.13 |
| 2006/0113329 | A1 | 6/2006 | Walters et al. | |
| 2007/0194050 | A1 | 8/2007 | Krampen et al. | |
| 2012/0024904 | A1 * | 2/2012 | Doulin | B05B 11/3061 222/207 |
| 2015/0298149 | A1 | 10/2015 | Alluigi | |
| 2016/0242528 | A1 | 8/2016 | Schmitz et al. | |
| 2016/0332180 | A1 | 11/2016 | Bruder et al. | |
| 2018/0056314 | A1 | 3/2018 | Schroeder | |
| 2018/0070780 | A1 | 3/2018 | Rodriguez | |
| 2019/0151875 | A1 | 5/2019 | Laidler | |

FOREIGN PATENT DOCUMENTS

| | | | |
|---|---|---|---|
| CN | 102099122 | A | 6/2011 |
| CN | 102464133 | A | 5/2012 |
| CN | 107708873 | A | 2/2018 |
| DE | 8316737 | U1 | 10/1983 |
| DE | 8713891 | U1 | 2/1989 |
| DE | 4411031 | A1 | 1/1995 |
| DE | 19803693 | A1 | 8/1999 |
| EP | 0117898 | A2 | 9/1984 |
| EP | 0368062 | A1 | 5/1990 |
| EP | 0492354 | A1 | 7/1992 |
| EP | 0803295 | A2 | 10/1997 |
| EP | 1815914 | A1 | 8/2007 |
| JP | S54-93213 | A | 7/1979 |
| JP | 2000-042458 | A | 2/2000 |
| JP | 3730018 | B2 | 12/2005 |
| JP | 2007-244937 | A | 9/2007 |
| WO | WO 98/03427 | | 1/1998 |
| WO | WO 01/03851 | | 1/2001 |
| WO | WO 2015/055266 | | 4/2015 |
| WO | WO 2015/106868 | | 7/2015 |
| WO | WO 2016/150889 | | 9/2016 |

OTHER PUBLICATIONS

Written Opinion for International Application No. PCT/EP2019/056488, dated July 4, 2019.
International Preliminary Report on Patentability for International Application No. PCT/EP2019/056488, dated Sep. 24, 2020.
Second Office Action (Including Translation) for corresponding Chinese Patent Application No. 201980019203.6, dated Apr. 9, 2022.
Office Action for corresponding European Patent Application No. 19711886.2, dated Jul. 7, 2022.
Examination Report for corresponding Indian Patent Application No. 202017039419, dated Jul. 12, 2022.

* cited by examiner

DISPENSING DEVICE AND DISPENSER

CROSS-REFERENCE TO RELATED APPLICATIONS

This application is a national stage application under 35 U.S.C. 371 of PCT Application No. PCT/EP2019/056488 having an international filing date of 14 Mar. 2019, which designated the United States, which PCT application claimed the benefit of German Application No. 10 2018 002 101.8, filed 15 Mar. 2018, each of which are incorporated herein by reference in their entirety.

The present invention relates to a dispensing device for dispensing a fluid according to the preamble of claim 1 or 10 and a dispenser for dispensing a fluid according to preamble of claim 18.

In particular, the present invention relates to a dispenser for the storage and the discharge and/or dispensing of cleaning agents or pharmaceutical or cosmetic fluids, in particular liquids. In a container of the dispenser, a fluid can be accommodated which can be conveyed out of the container by means of a dispensing device attached to the container and can be dispensed from the dispenser by means of the dispensing device. The fluid can be dispensed in various forms, for example as spray or aerosol or as foam.

In principle, however, the following invention is versatile and can be used in any technical field in which a fluid is dispensed from a container.

WO 2015/106868 A1 discloses a dispenser for liquids with a liquid reservoir in which the liquid is stored before discharge, with an outlet channel through which the liquid can be discharged to an environment, and with a pump chamber which can be reduced in volume by means of an actuating handle. An inlet valve of the pump chamber is formed by a ring-shaped sealing lip which is pretensioned against a counter surface and thus sealingly abuts on the counter surface.

US 2012/0024904 A1 discloses a liquid dispenser with a pumping device which is formed by a flexible bellows and by which liquid can be conveyed from a container of the dispenser. The pumping device is actuated or the bellows compressed by pressing down an axially movable actuating handle, which also has an outlet opening for the fluid. An inlet and outlet valve open automatically.

U.S. Pat. No. 5,114,052 concerns a manually operated trigger pump. An actuating lever is formed by a film hinge integral with a main body of a spray cap. The actuating lever engages with two knob-like guide elements in guide rails arranged on a bellows in a form-fit manner so that the bellows can be compressed with the actuating lever for fluid dispensing.

U.S. Pat. No. 3,840,157 concerns a manually operated spray device for dispensing a liquid with an actuating lever. By means of the actuating lever a cylinder-piston-arrangement for conveyance or dispensing of the liquid can be actuated. When actuated, the cylinder-piston-arrangement is lifted from an associated seat so that air can pass between the seat and the cylinder-piston-arrangement into the container.

DE 198 03 693 A1 concerns a spray pump with a flexible bellows which is operated by an actuating lever. The bellows is designed in one piece with a base. A valve element of a valve is formed by a ball.

DE 4411031 A1 concerns a pump operated by a hand lever, which is formed by a cylinder-piston-arrangement.

U.S. Pat. No. 4,278,187 A1 concerns a pump arrangement with a safety mechanism to secure an actuating lever. The actuating lever has a hook which is hooked into a lip to secure the operating lever.

US 2006/0113329 A1 concerns a dispenser that has a locking sleeve. The locking sleeve can be rotated between a first position in which operation of the dispenser is prevented and a second position in which operation of the dispenser is enabled.

It is an object of the present invention to enable a simple, reliable and/or safe functioning and/or a simple construction of a dispenser and/or dispensing device and/or to prevent an actuation and/or an escape of fluid during the transport of a dispenser in a simple and/or inexpensive manner.

The above object is solved by a dispensing device according to claim 1 or 10 or by a dispenser according to claim 18. Advantageous further developments are subject of the subclaims.

The dispensing device according to the proposal is designed to dispense a fluid, in particular one contained in an associated container and/or one connected to the dispensing device.

The dispensing device preferably has a pumping device with a flexible bellows for conveying the fluid. In particular, the fluid can be conveyed into the bellows by expansion of the bellows and/or a negative pressure created by the expansion and can be dispensed from the bellows by compression of the bellows.

The pumping device preferably has a base which is connected to the bellows on an inlet side of the bellows. The base preferably has or forms a supply channel for the fluid.

According to a first aspect of the present invention, the dispensing device has an actuating lever for actuating the pumping device and/or dispensing device. The base of the pumping device preferably has or forms an actuating surface for the actuating lever. This is conducive to simple and reliable actuation of the pumping device and/or dispensing device and/or compression of the bellows.

It is not mandatory for the present invention that the dispensing device has both an actuating lever and a pumping device with a flexible bellows. The actuating lever for actuating the dispensing device is preferably also realizable without a pumping device formed by a flexible bellows and/or realizable with any other pumping device. Likewise, it is possible that the proposed dispensing device has a flexible bellows which is actuated in a different way than with an actuating lever. However, the combination of the actuating lever and the pumping device with a flexible bellows has proven to be particularly advantageous in a synergistic way.

According to another aspect of the present invention, which can also be realised independently, a conduit of the base forming or having the supply channel is sealingly held in a seat or guide. The conduit preferably has an in particular conical taper on the outside, so that the conduit is lifted from the seat or guide when the dispensing device is actuated and/or when the base is moved axially, and in this way a ventilation gap for ventilating a container is formed between the guide and the conduit. This allows for easy ventilation of the container with a simple design of the dispensing device. In particular, an additional ventilation valve or the like can be dispensed with.

According to another aspect, which can also be realized independently, the dispensing device has an inlet valve with a valve element for sealingly covering an end opening of the supply channel. The valve element is preferably designed in one piece with the bellows and is held by one or more flexible arms of the bellows. This is conducive to a reliable sealing of the supply channel and/or allows a simple assembly with few parts.

According to another aspect, which can also be implemented independently, the actuating lever has a manually actuatable actuating arm. The actuating arm can preferably be secured against (undesired) actuation, in particular in a securing position, by folding it down and/or on a spray head of the dispensing device. In this way it can be prevented that during the delivery and/or transport of a dispenser filled with a liquid and having a proposed dispensing device, fluid unintentionally escapes from the dispenser. In particular, no additional transport securing device or one separate from the dispenser or the dispensing device has to be provided or attached to the dispensing device or the dispenser. This enables a cost-effective production and/or delivery, as in particular additional securing devices and/or securing parts are not required. In particular, the proposed solution is also particularly environmentally friendly, as less waste is produced.

According to another aspect, which can also be implemented independently, the actuating lever and/or actuating arm can be secured against actuation in a securing position and, in particular with the actuating lever in the securing position, an outlet opening of the dispensing device can be closed. In this way, a double securing can be realized and/or an unintentional escape of a fluid can be effectively prevented.

According to another aspect, which can also be implemented independently, the actuating lever and/or actuating arm can be secured or blocked against actuation by a movable blocking element. The blocking element is preferably arranged or arrangeable between the actuating lever and/or actuating arm and a housing of the dispensing device, in particular so that the blocking element blocks the actuating lever and/or actuating arm against unwanted actuation and/or the position of the actuating lever is fixed relative to the housing. In this way a reliable securing and/or blocking of the actuating lever can be easily achieved.

The actuating lever is in particular designed to move the base axially and/or to compress the bellows. This is conducive to simple and reliable operation.

The actuating lever is preferably arranged and/or mounted pivotably on the dispensing device. This is conducive to a simple design and/or cost-effective production.

The actuating lever preferably has or is formed by an actuating arm for manual actuation and a lifting arm for moving the base. The lifting arm preferably is or can be arranged transversely, in particular at right angles, to the actuating arm, at least in a position of use of the actuating lever.

Preferably, the actuating arm is movably connected to the lifting arm by a film hinge. This enables the actuating arm to be folded away from the lifting arm in a simple and cost-effective manner.

Preferably, the actuating arm can be fixed to the lifting arm in a position of use, in particular by means of a latching connection. This enables simple and reliable operation and/or actuation of the actuating arm which can be folded away. A closure of the dispensing head and/or the outlet opening is preferably designed to secure—at least in a closed position—the actuating lever and/or actuating arm against actuation. This makes it easy to secure it for transport without additional components.

The actuating lever and/or actuating arm can preferably be secured with the closure of the dispensing head or the outlet opening by positive-locking and/or by latching. This is conducive to reliable securing.

According to another aspect, which can also be realised independently, the present invention relates to a dispenser for dispensing a fluid with the dispensing device and a container. The fluid can be conveyed from the container with the dispensing device and dispensed from the dispenser by means of the dispensing device.

The aforementioned and subsequent aspects and features of the present invention may be combined with each other in any way, but may also be realized independently of each other.

Figure 2:
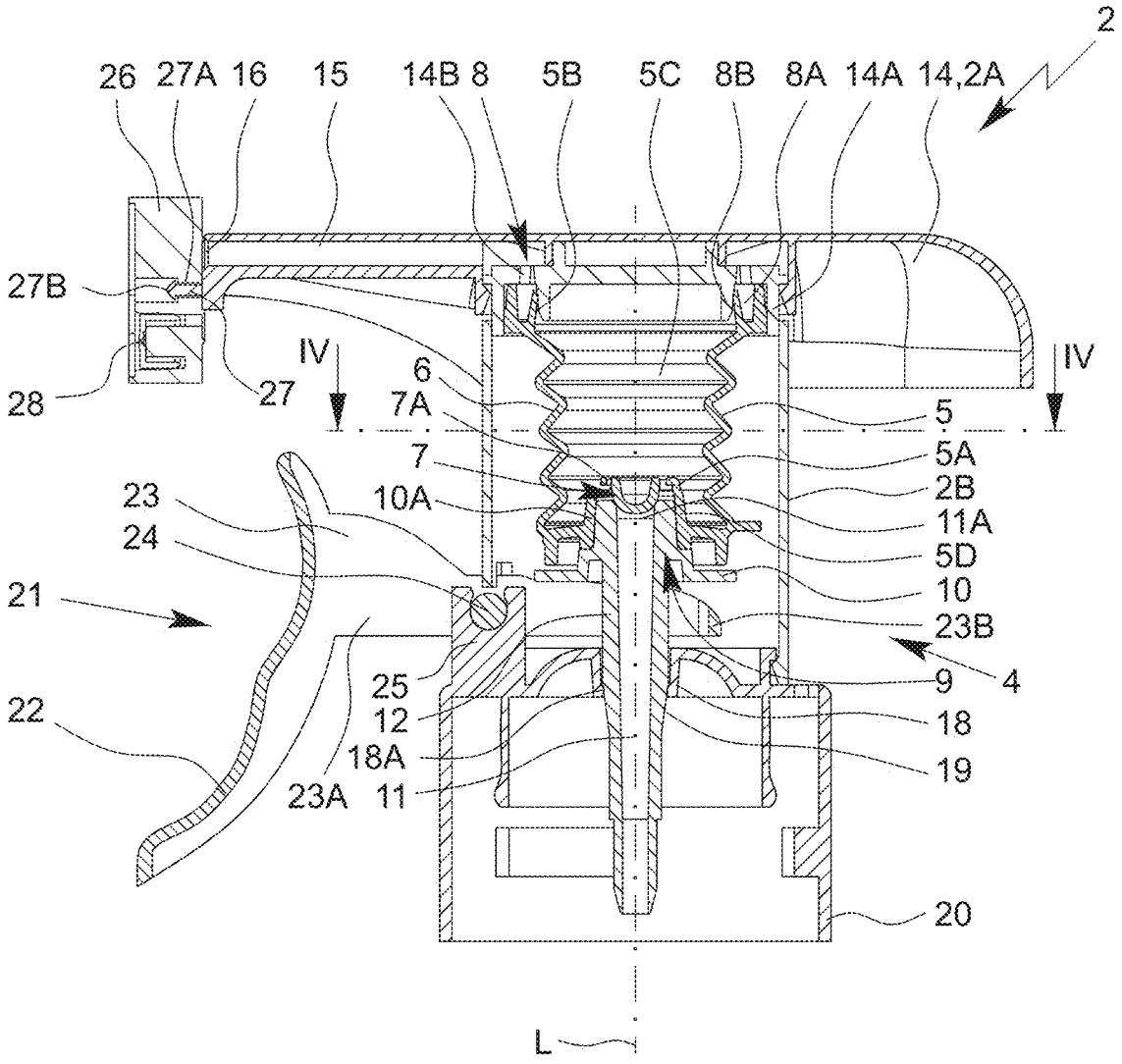
Figure 3:
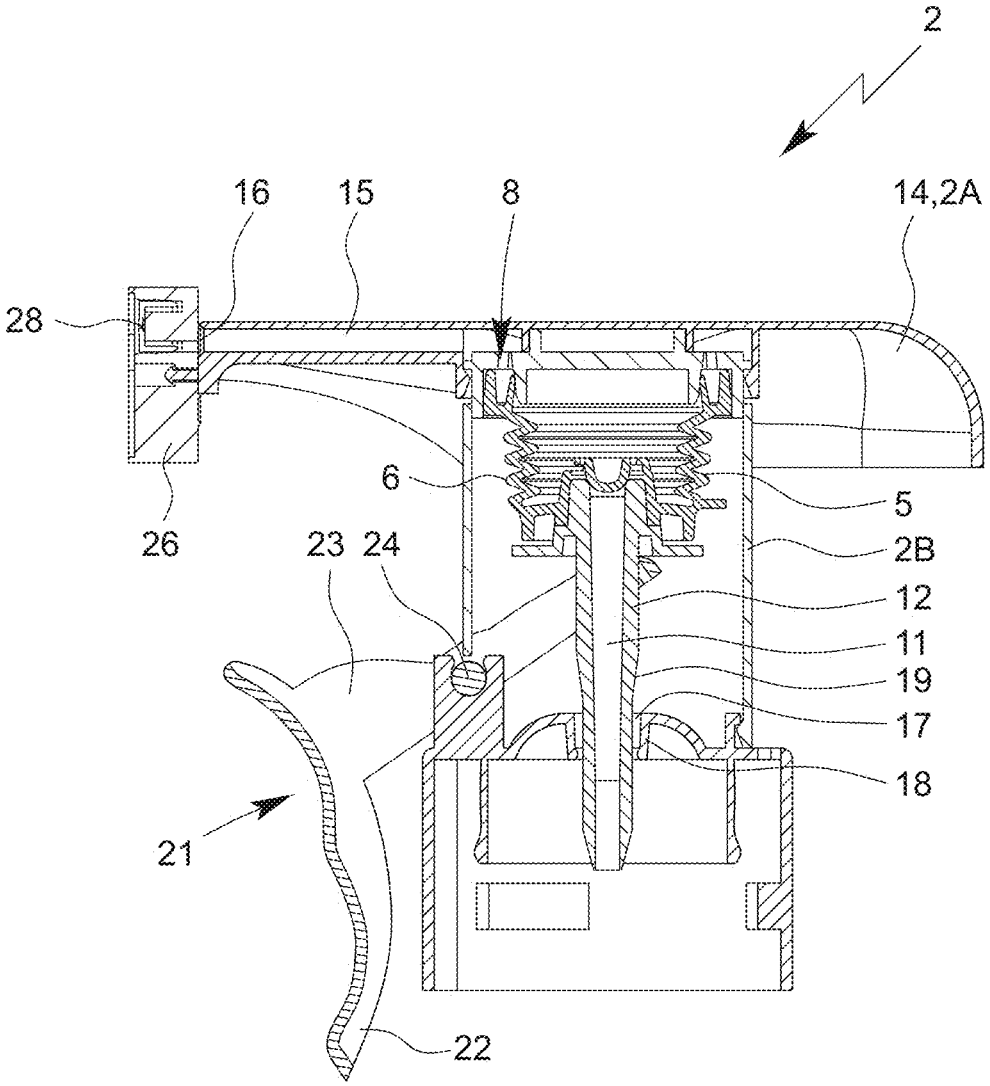
Figure 4:
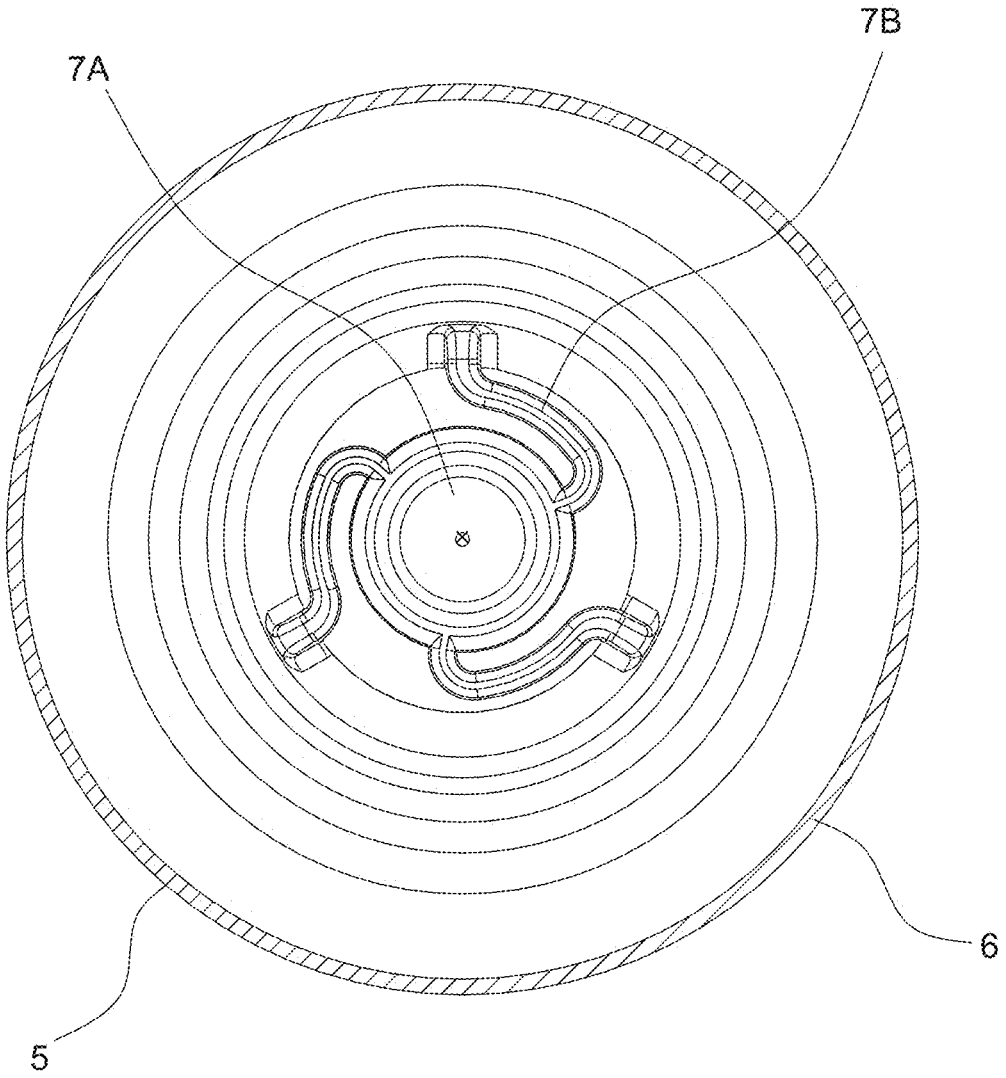
Figure 5:
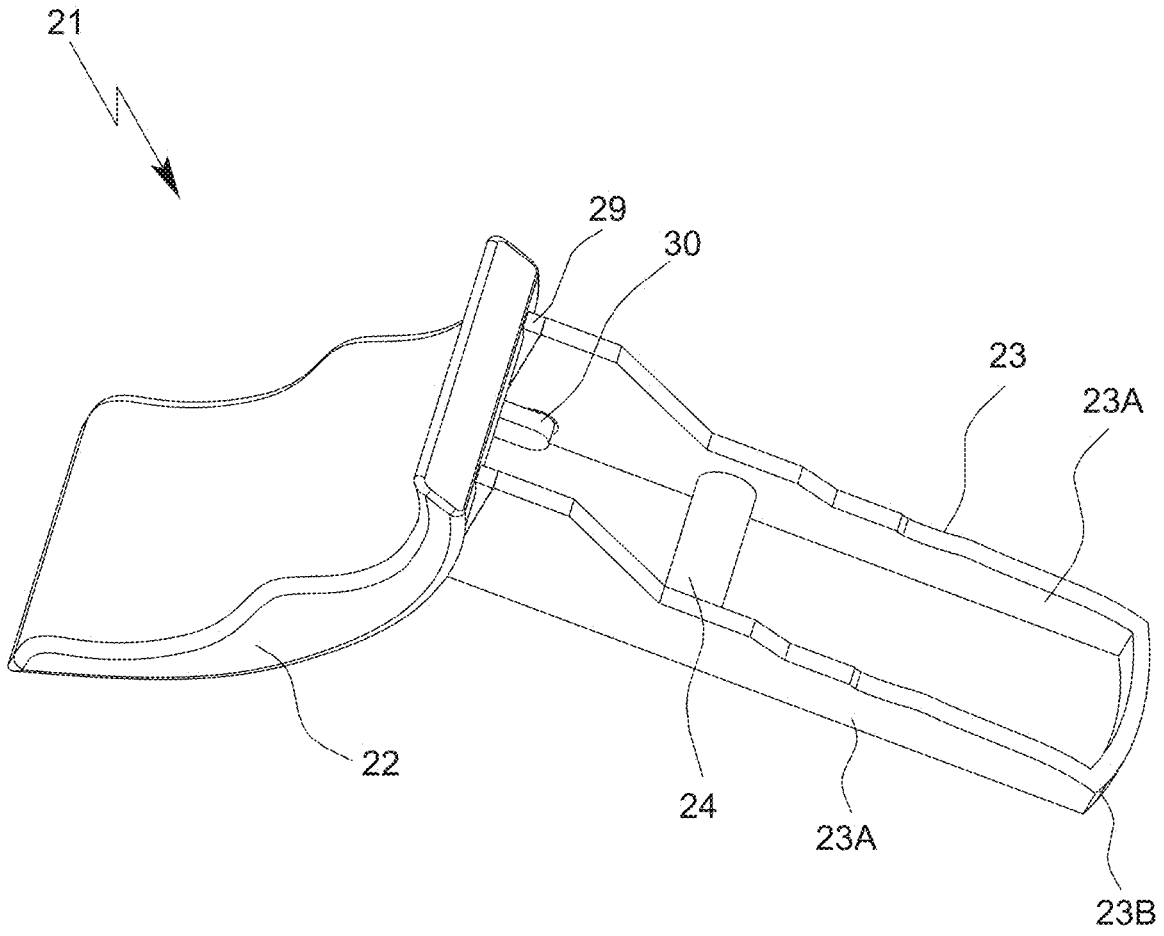
Figure 6:
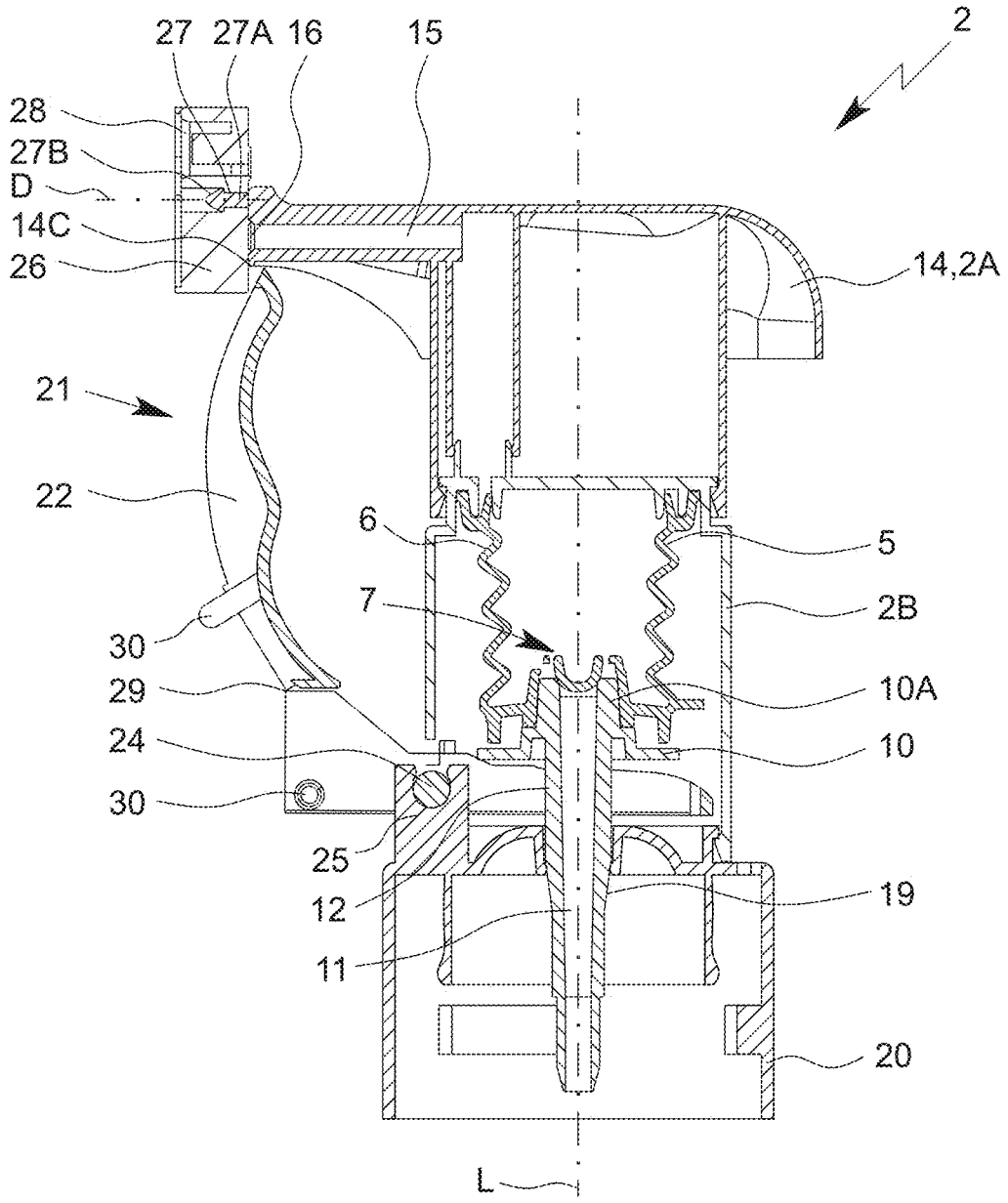
Figure 7:
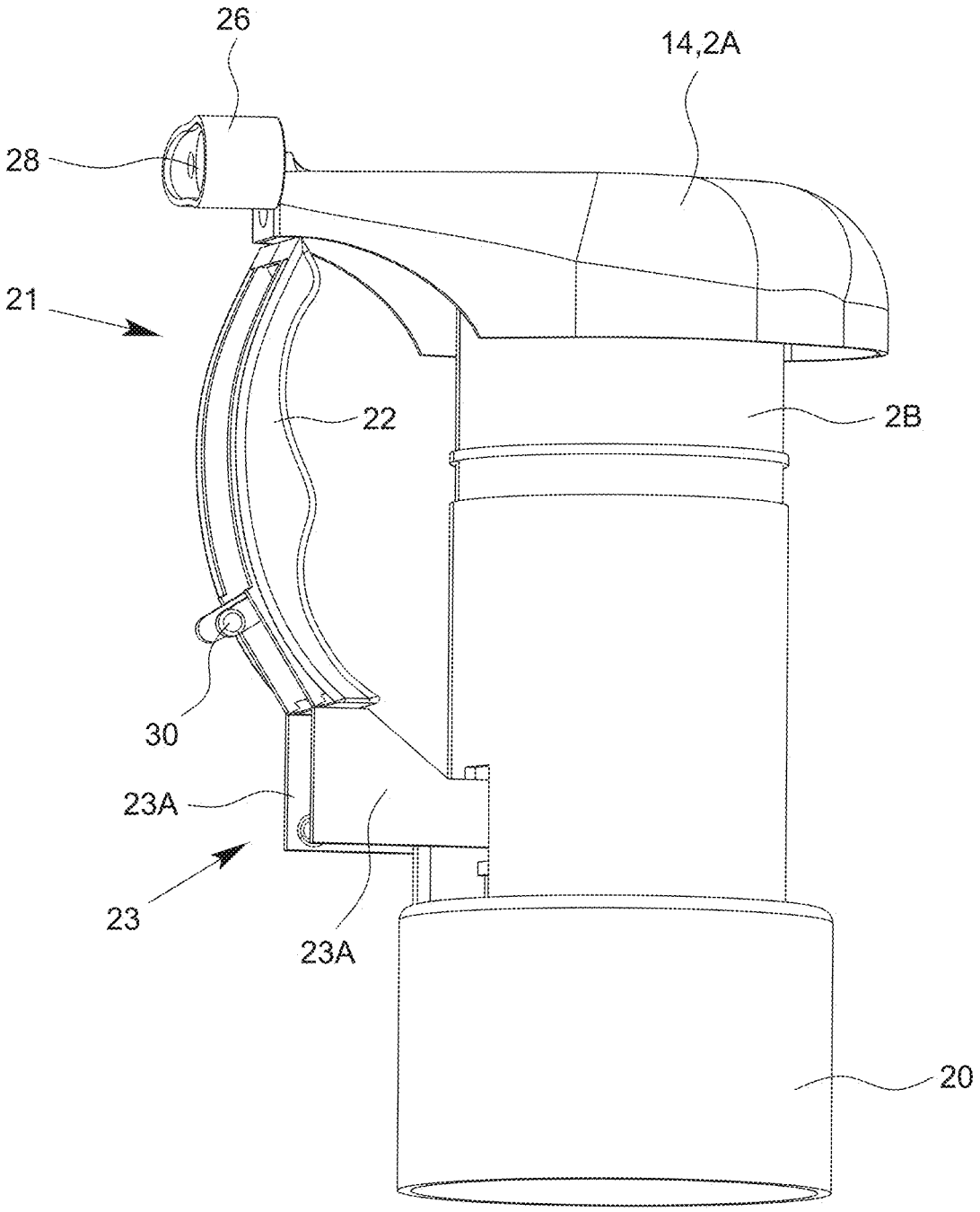
Figure 8:
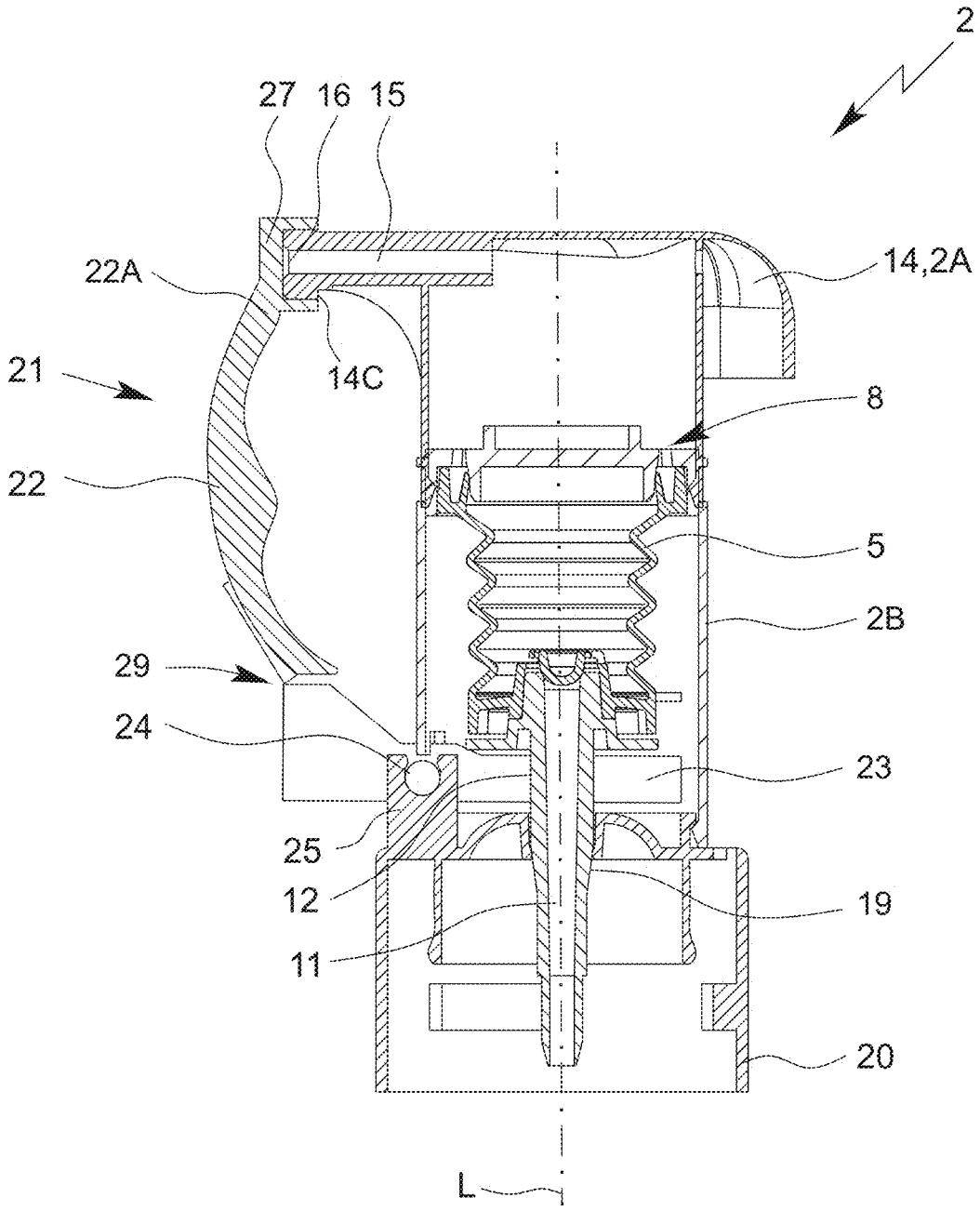
Figure 9:
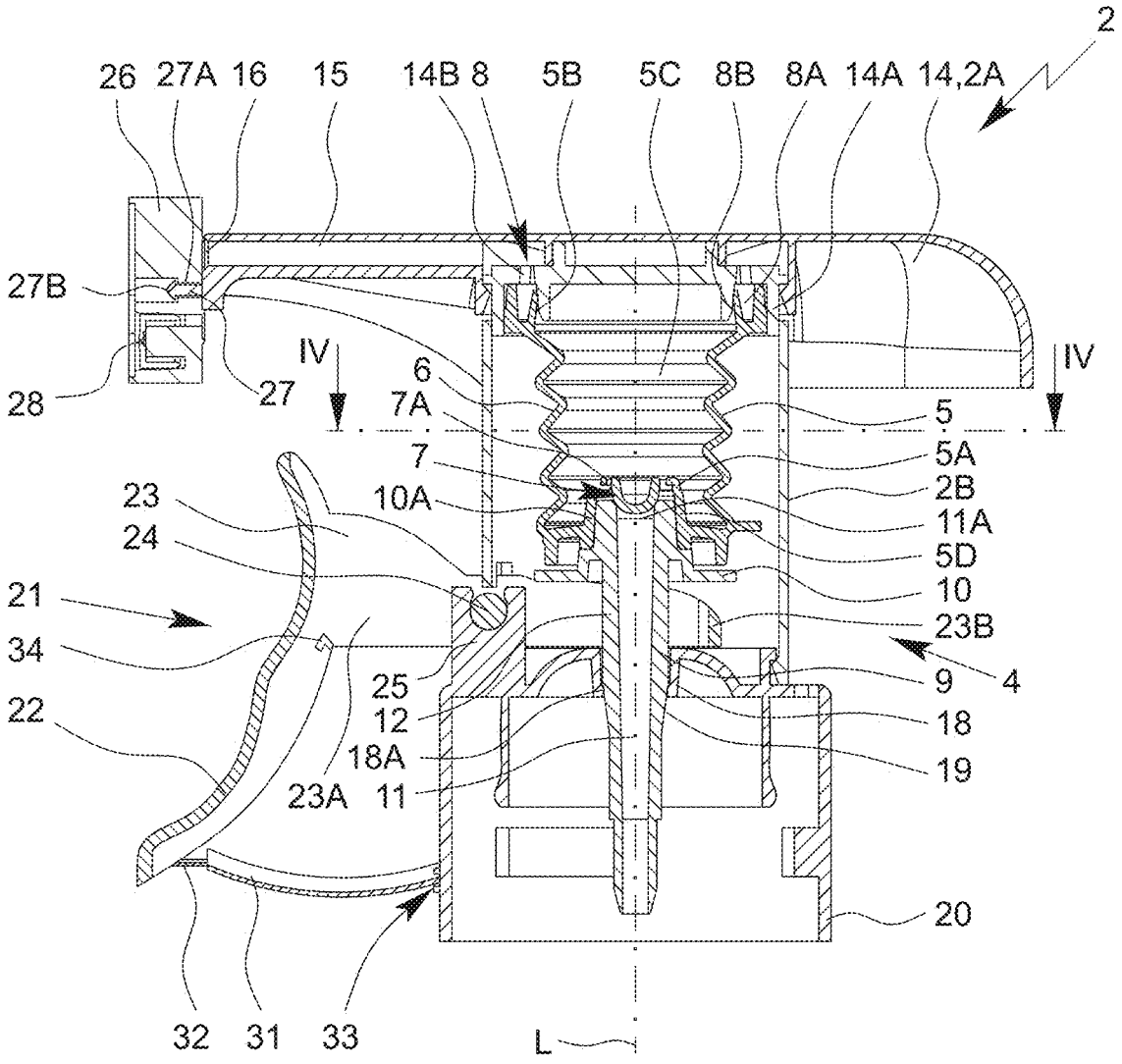
Figure 10:
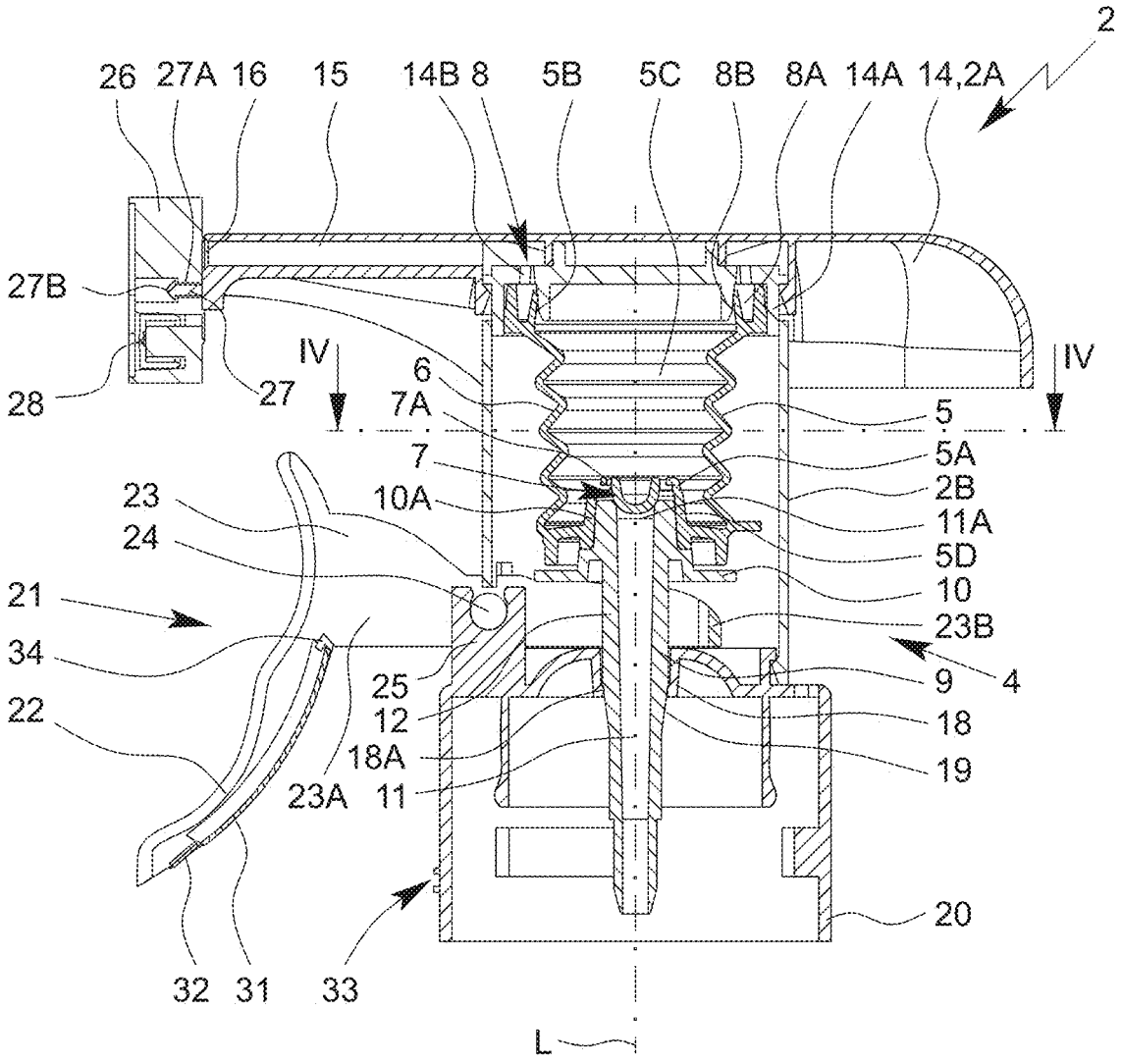

Further aspects, features, advantages and properties of the present invention are apparent from the claims and the following description of a preferred embodiment based on the drawing. It shows:

FIG. 1 a section of a proposed dispenser with a proposed dispensing device according to a first embodiment;

FIG. 2 an enlarged section of the dispensing device;

FIG. 3 a section of the dispensing device when the pumping device is actuated;

FIG. 4 a section through a bellows of the pumping device along the intersection line IV-IV from FIG. 2;

FIG. 5 a perspective view of an actuating lever of the dispensing device;

FIG. 6 a section of a dispensing device according to a second embodiment in a securing position;

FIG. 7 a perspective view of the dispensing device from FIG. 6 with released or unlocked actuating lever;

FIG. 8 a section of a dispensing device according to a third embodiment in a securing position;

FIG. 9 a section of a dispensing device according to a fourth embodiment with a secured actuating lever; and FIG. 10 a section of the dispensing device from FIG. 9 with the actuating lever unlocked.

In the figures, the same reference numbers are used for identical or similar components and devices, and the same or corresponding advantages and characteristics may result, even if a repeated description is omitted.

FIG. 1 shows a proposed dispenser 1 with a proposed dispensing device 2 and a container 3.

A fluid F may be contained in the dispenser 1 or container 3. The dispensing device 2 is designed to convey the fluid F from the container 3 and to discharge and/or dispense the fluid F.

The fluid F is preferably a (low-viscosity) liquid, in particular a cleaning fluid or similar, but can also have a viscid to pasty consistency and/or a high viscosity. The fluid F is preferably dispensed with the dispensing device 2 as a spray or aerosol or as a foam. However, other solutions are also possible.

The dispenser 1 is preferably marketed and/or sold to an end customer as a disposable item and filled with the Fluid F. The dispenser 1 is particularly suitable for cleaning fluids such as glass cleaners or similar, but can also be used for any other fluid.

The dispenser 1 and/or the dispensing device 2 preferably have or form a housing 2A. The housing 2A is preferably made up of several parts.

The container 3 preferably forms part or section of the housing 2A of the dispenser. Preferably, the housing 2A has the container 3.

The proposed dispensing device 2 is preferably equipped with a pumping device 4 to convey the fluid F, in particular from the container 3.

In the preferred embodiment of pumping device 4 shown here, the pumping device 4 has a bellows 5 or is formed by the bellows 5. Instead of the bellows 5, however, other solutions for the pumping device 4 are also possible.

The pumping device 4 and/or the bellows 5 are preferably at least partly arranged inside the housing 2A or accommodated in the housing 2A.

Preferably, the bellows 5 is flexible and/or elastically deformable and/or consists of a flexible and/or elastically deformable material.

The bellows 5 is preferably designed to return after a deformation to a starting position and/or unactuated position and/or rest position assumed before the deformation. This will be discussed in more detail later.

The bellows 5 is preferably installed and/or arranged in the dispenser 1 and/or the dispensing device 2 and/or the pumping device 4 in such a way that it is pre-tensioned and/or (slightly) compressed. This supports in particular a reliable conveyance of the fluid F.

The bellows 5 is preferably at least essentially cylindrical or hollow cylindrical. A lateral surface or side wall 6 of the bellows 5 is preferably wavy and/or corrugated. Preferably, this increases the flexibility and/or elastic restoring force that drives and/or moves the bellows 5 back to the starting position and/or rest position. Furthermore, the wavy design preferably prevents damage in case of a deformation of the bellows 5 and/or increases the stability of the bellows 5.

The bellows 5 and/or the side wall 6 is preferably coaxial with a central or longitudinal axis L of the dispenser 1 and/or the dispensing device 2.

The axis L is preferably at least substantially vertical in a normal storage position and/or position of use of dispenser 1, as also shown in the figures. In particular in use, the dispensing device 2 and/or its dispensing head 14 is usually on top and the container 3 is at the bottom. In particular, the axis L, at least in the storage position, is parallel to gravity. In the storage position, the dispenser 1 preferably stands on a bottom of container 3.

In the present invention, an "axial" direction and/or movement is preferably understood to be a direction and/or movement which runs along or parallel to the axis L. Analogously, the term "radial" preferably also refers to the axis L. The terms "top" and "bottom" as well as variations thereof and similar terms have in the present invention preferably the usual general language meaning with respect to the preferred orientation and/or position of use and in the present invention preferably refer to the storage position of dispenser 1 and/or dispensing device 2 as shown in the figures.

The pumping device 4 and/or bellows 5 preferably has an inlet 5A for the fluid F, an outlet 5B for the fluid F and a pumping chamber or interior 5C to receive the fluid F. The interior 5C is preferably formed between the inlet 5A and the outlet 5B and/or is limited laterally and/or radially by the side wall 6.

Preferably, the pumping device 4 and/or bellows 5 has an inlet valve 7 at inlet 5A and an outlet valve 8 at outlet 5B. The inlet valve 7 and the outlet valve 8 are preferably each designed as one-way valve. The inlet valve 7 enables and/or controls a supply of the fluid F to the bellows 5. The outlet valve 8 enables and/or controls a discharge of the fluid F from the outlet 5B of the bellows 5.

The inlet valve 7 and the outlet valve 8 open and/or close preferably pressure-controlled and/or automatically, in particular by a pressure difference at the respective valve 7, 8. The specific design of valves 7, 8 will be discussed in more detail later.

The pumping device 4 and/or the bellows 5 preferably has a base 9. The base 9 is preferably designed as a component which is separate and/or separately manufactured from the bellows 5.

The base 9 is preferably axially movable and/or arranged within the housing 2A.

The base 9 is connected to the bellows 5, in particular on the inlet side. Preferably, the bellows has a fastening section 5D, by which the bellows 5 is connected to the base 9. The fastening section 5D is preferably at least essentially hollow cylindrical, ring-shaped or conical. The fastening section 5D can be connected to the base 9 in a non-positive or frictional manner and/or adhesively connected and/or fastened to the base 9, in particular latched, glued, welded and/or injection-moulded. The fastening section 5D preferably runs coaxially to the axis L.

The base 9 preferably has a floor element 10. The bottom element 10 is preferably of plate-like design and/or preferably forms a (lower) end surface or a (lower or end) closure of the pumping device 4 or the bellows 5 or the interior 5C. The base element 10 is preferably at least essentially circular disc-shaped and/or forms an annular surface.

The bottom element 10 preferably has a ring section 10A, in particular complementary to the fastening section 5D, which is in particular arranged coaxially with the axis L and/or the fastening section 5D. Preferably, the fastening section 5D is fastened to or connected to the ring section 10A.

The base 9 preferably has or forms a supply channel 11 for the fluid F, running in particular axially or parallel to the axis L. Preferably, the supply channel 11 opens into the inlet 5A of the bellows 5.

The supply channel 11 is preferably formed or limited by a conduit 12 of the base 9.

The conduit 12 and the bottom element 10 are preferably designed as one piece.

The base 9 with the bottom element 10 and the supply conduit 12 can, for example, be designed and/or manufactured as an injection-moulded component and/or made of plastic.

The bottom element 10 is preferably arranged at a distance from the upper axial end of the conduit 12 or the axial end of the conduit 12 that faces the bellows 5 and/or from the lower axial end of the conduit 12 or the axial end of the conduit 12 that faces the container 3.

Particularly preferably, the conduit 12 forms a connection and/or protrudes downwards and/or into the container 3.

The fastening section 5D is preferably arranged and/or fixed at an upper axial end of the conduit 12 or at the axial end facing the bellows 5.

The dispenser 1 and/or the dispensing device 2 and/or the pumping device 4 preferably has a riser 13 for the fluid F. The riser 13 is preferably connected to the bellows 5 and/or the base 9, in particular to the supply channel 11 or the conduit 12, and/or is arranged at a lower end of the base 9 or conduit 12 or at an end of the base 9 or conduit 12 facing away from the bottom element 10 and/or the bellows 5. The riser 13 can be plugged into the conduit 12 or put on the conduit 12 or connected to the conduit 12 in another way.

The riser 13 preferably forms an extension of the conduit 12 and/or the supply channel 11. Preferably, the conduit 12 and the riser 13 together form and/or limit the supply channel 11.

The dispenser 1 and/or the dispensing device 2 preferably has a spray head or dispensing head 14 for the discharge and/or dispensing of the fluid F.

Preferably, the dispensing head 14 forms a part or section of the housing 2A and/or the housing 2A has the dispensing head 14.

The dispensing head 14 is preferably arranged on the outlet side of the bellows 5 and/or the pumping device 4 and/or fluidically connected or connectable to the bellows 5 and/or the outlet 5B.

The dispensing head 14 preferably has a fastening part 14A for connecting and/or fastening the pumping device 4 and/or the bellows 5 with/on the dispensing head 14. The fastening part 14A is preferably a component separate or separately manufactured from the dispensing head 14. However, other solutions are also possible here.

Preferably, the fastening part 14A has one or more breakthroughs 14B for the fluid F, which are preferably designed slot-like.

The dispensing head 14 preferably has or forms an outlet channel 15, which in particular runs transversely or perpendicularly to the axis L. The outlet channel 15 is preferably fluidically connected or connectable to the outlet 5B, in particular through the breakthrough(s) 14B in the fastening part 14A, and opens into an outlet opening 16. Preferably, the fluid F can exit the dispensing head 14 and/or be dispensed from the dispenser 1 and/or the dispensing device 2 via the outlet channel 15 and the outlet opening 16.

A dispensing of the fluid F from the dispenser 1 and/or the dispensing device 2 preferably takes place by actuating the pumping device 4 and/or the bellows 5, in particular by means of an actuating lever 21. The actuating lever 21 will be discussed in more detail later.

When using the dispenser 1 for the first time, it may be necessary to first operate pumping device 4 a few times to remove air from the pumping device 4 and/or to convey fluid F from the container 3 to the dispensing device 2 and/or the pumping device 4 and/or the bellows 5 for the first time.

When the pumping device 4 is actuated, the fluid F preferably passes from the container 3 to the dispensing device 2 and/or the pumping device 4 and/or the bellows 5 via the supply channel 11 and/or the conduit 12 and/or the riser 13.

Preferably, the inlet valve 7 is designed in such a way that it opens when the fluid F is conveyed with the pumping device 4 and/or when fluid pressure is present on the supply channel side, thus allowing the fluid F to be conveyed from the supply channel 11 through the inlet valve 7 into the interior 5C of the bellows 5.

The bellows 5 is preferably positionable or arrangeable in an unactuated position or rest position, which is shown in FIG. 1, and in an actuated or compressed position, which is shown in FIG. 3, and/or deformable into these positions.

The bellows 5 is preferably designed to automatically assume the rest position or to return to this position, in particular by elastic return, if no force deforming the bellows 5 from the rest position acts on the bellows 5. Preferably, the bellows 5 is compressed axially or along the axis L in the actuated position. The compression of the bellows 5 in particular takes place axially or parallel to the axis L and/or by pushing together or folding the corrugated side wall 6.

On the outlet side, the bellows 5 is preferably stationary and/or immovably held or fixed, in particular by or on the dispensing head 14. Preferably, the outlet 5B and/or the dispensing head 14 do not change their (axial) position relative to the housing 2A and/or the container 3 in case of a compression or deformation of the bellows 5 and/or in case of an actuation of the dispensing device 2 and/or the dispenser 1.

On the inlet side, the bellows 5 is preferably movably held or fixed, in particular by or at the base 9. Preferably, the inlet 5A and/or the base 9 change their (axial) position relative to the housing 2A and/or the container 3 in case of a compression or deformation of the bellows 5 and/or in case of an actuation of the dispensing device 2 and/or dispenser 1.

Preferably, an axial movement of the base 9, in particular upwards and/or in the direction of the bellows 5, and/or a compression and/or volume reduction of the bellows 5 takes place when or by actuating the pumping device 4.

The compression and/or reduction in volume of the bellows 5 causes an increased pressure of the fluid F in the interior 5C of the bellows 5, so that the fluid F is present at an increased pressure at the outlet valve 8, which preferably causes the outlet valve 8 to open.

The compression of the bellows 5 therefore preferably causes the fluid F to enter the outlet channel 15 through the outlet valve 8 and to leave the outlet channel 15 through the outlet opening 16 and thus to be dispensed from or by the dispensing device 2.

When the actuation of the pumping device 4 is terminated and/or no compressive force (any more) acts on the bellows 5, the bellows 5 preferably returns to the rest position, in particular by elastic return.

Preferably, the expansion of the bellows 5 from the compressed or actuated position to the rest position reduces the pressure in the interior 5C of the bellows and/or creates a negative pressure in the bellows 5 or its interior 5C during expansion, which preferably causes the outlet valve 8 to close. In addition, the inlet valve 7 is preferably opened by negative pressure, so that the fluid F in the supply channel 11 at the inlet valve 7 flows or can flow through the inlet valve 7 into the interior 5C of the bellows 5.

The inlet valve 7 is preferably formed by the conduit 12 and the bellows 5. In particular, the inlet valve 7 and/or the bellows 5 has a valve element 7A which is formed in one piece with the bellows 5. When the inlet valve 7 is in the closed position, the valve element 7A preferably fluid-tightly closes off an opening 11A at the end and/or leading into the interior 5C of the supply channel 11 and/or the conduit 12. In particular, the opening 11A is sealingly covered by the valve element 7A—at least in the closed position.

The valve element 7A is preferably held by one or more, in particular flexible, arms 7B of the bellows 5, in particular in the closed position. The arms 7B are preferably of a bridge-like design.

The arms 7B are in particular shown in FIG. 4.

The valve element 7A is preferably preloaded against the opening 11A and/or the supply channel 11, in particular by means of the arms 7B.

The arms 7B are preferably arranged between the fastening section 5D of the bellows 5 and the valve element 7A. The valve element 7A is preferably arranged coaxially to and/or centrally in the fastening section 5D.

The arms 7B preferably lie in a plane transverse, in particular perpendicular, to the axis L.

Preferably, one end of each arm 7B is attached to valve element 7A and/or one end of each arm 7B is attached to the fastening section 5D.

The arms 7B can project radially or tangentially from and/or run radially or tangentially to valve element 7A.

Preferably, the arms 7B are curved and/or run at their ends at least substantially radially and in a central section and/or a section spaced from the ends in the shape of an arc of a circle and/or coaxial with the axis L, in particular parallel to the outer contour of the valve element 7A and/or to the inner edge of the fastening section 5D. As a result, the curved arms 7B are lengthened in relation to radially extending or arranged arms 7B, so that opening the inlet valve 7 is facilitated.

The outlet valve 8 is preferably formed by an in particular ring-like sealing lip 8A, which—at least in the closed state of the outlet valve 8—sealingly abuts on a counter surface 8B, in particular is pretensioned against the counter surface 8B, the surface 8B preferably being ring-like and/or arranged coaxially to the axis L. In an open position of the outlet valve 8, the sealing lip 8A is lifted from the counter surface 8B, so that a gap is formed between the sealing lip 8A and the counter surface 8B, through which the fluid F can exit the interior 5C of the bellows 5 and enter the outlet channel 15.

Preferably, the fastening part 14A has or forms the counter surface 8B.

Preferably, the dispenser 1 and/or the dispensing device 2 is designed in such a way that when the pumping device 4 is actuated, an automatic ventilation of the container 3 takes place or is effected so that no (too high) negative pressure is created in the dispenser 1 and/or container 3 during or by the conveyance and/or dispensing of the fluid F from the container 3. Such a negative pressure could lead to a deformation of the container 3 and/or prevent or hinder (further) conveyance of the fluid F from the container 3, which is undesirable.

The dispenser 1 and/or the dispensing device 2 is preferably designed so that when the pumping device 4 is actuated, in particular when the bellows 5 and/or the base 9 moves axially, a ventilation gap 17 is formed through which ventilation of the container 3 is enabled and/or takes place.

Preferably, the dispensing device 2 has or forms a seat or guide 18 for the base 9 or the conduit 12.

Preferably, the ventilation gap 17 can be formed between the conduit 12 and the guide 18.

The ventilation gap 17 is preferably ring-shaped.

The guide 18 is preferably at least in sections ring-shaped and/or hollow cylindrical. The guide 18 is in particular arranged coaxially to the axis L.

The conduit 12 is preferably held by the guide 18 and/or within the guide 18 and/or arranged or arrangeable in the guide 18.

The ventilation gap 17 is formed in particular by the conduit 12 being lifted off and/or spaced from the guide 18 during an axial movement.

In particular, the ventilation gap 17 between the guide 18 and the conduit 12 is formed when the pumping device 4 is actuated, in particular when the bellows 5 is compressed and/or deformed from the rest position to the compressed position and/or when the base 9 is moved axially upwards and/or towards the dispensing head 14.

During the axial movement of the base 9 or conduit 12, the ventilation gap 17 is preferably formed by the fact that the conduit 12 has or forms on the outside a (conically) tapered section and/or an in particular conical taper 19.

The taper 19 is preferably located in the area of the guide 18 on conduit 12.

By the taper 19, the outer diameter of the conduit 12 is preferably altered, in particular reduced downwards and/or with increasing distance from bellows 5.

By the taper 19, the distance between the conduit 12 or taper 19 and the guide 18 is changed, in particular increased, in particular when the base 9 and/or conduit 12 moves axially (in the direction of the bellows 5 and/or upwards), so that the ventilation gap 17 is formed.

The guide 18 preferably forms and/or has a seat and/or stop 18A for the conduit 12. The stop 18A is preferably designed to prevent and/or block an axial movement of the base 9 and/or conduit 12 downwards and/or in the direction of the container 3. The stop 18A is preferably designed as a projection projecting radially inwards from the guide 18 or its inner side, in particular as an annular bead.

Preferably, the dispenser 1 and/or dispensing device 2 has an attachment or connection part 20.

Preferably, the connection part 20 forms a part or section of the housing 2A and/or the housing 2A has the connection part 20.

The connection part 20 preferably has or forms the guide 18.

Preferably, the dispensing device 2 is attached to the container 3 with or through the connection part 20. The connection part 20 can, for example, be screwed on the container 3 and/or latched to the container 3. However, other solutions are also possible.

The connection part 20 is preferably arranged axially between the container 3 and the bellows and/or the dispensing head 14.

The dispenser 1 and/or the dispensing device 2 and/or the housing 2A preferably has a housing part 2B. Preferably, the housing part 2B forms a part or section of the housing 2A. The housing part 2B is preferably at least essentially sleeve-like or ring-shaped and/or hollow cylindrical and/or arranged coaxially to the axis L.

The housing part 2B is preferably arranged (axially) between the connection part 20 and the dispensing head 14 or connects these.

Preferably, the bellows 5 is arranged inside the housing part 2B and/or coaxially to it.

The dispensing head 14, the fastening part 14A, the housing part 2B and/or the connection part 20 can each be connected to each other in a non-positive, positive and/or bonding manner, in particular by latching, screwing, gluing, welding or injection-moulding. It is also possible that one or more of the aforementioned parts 14, 14A, 2B, 20 are formed in one piece and/or form different sections of a single component.

Preferably, the dispensing device 2 and/or pumping device 4 has an actuating lever 21 for the in particular manual actuation of the dispensing device 2 and/or pumping device 4. Preferably, the pumping device 4 and/or compression of the bellows 5 for dispensing the fluid F is effected (exclusively) by (manual) actuation of the actuating lever 21 by a user not shown.

At this point, it should be noted that the pumping device 4 and/or dispensing device 2 can also be realized without the actuating lever 21 or can be actuatable in a different way than with the actuating lever 21, which is described in more detail below. Solutions are conceivable here, for example, in which the actuation of the pumping device 4 and/or a compression of the bellows 5 is effected by an axial movement or by pressing down a dispensing head, as described for example in WO 2015/106868 A1 or US 2012/0024904 A1.

Likewise, is possible that the properties and features of the actuating lever 21 described below, in particular with regard to securing against actuation, are provided independently of the realization of the pumping device 4 by or with a flexible bellows. For example, a cylinder-piston-arrangement is also conceivable instead of the bellows 5, for example similar to the cylinder-piston-arrangement described in U.S. Pat. No. 3,840,157.

The actuating lever 21 is preferably pivotably arranged and/or mounted on the dispensing device 2 and/or the housing 2A.

The actuating lever 21 preferably has or is formed by an actuating arm 22 and a lifting arm 23 which is in particular coupled to the actuating arm 22.

The actuating arm 22 is preferably arranged outside the housing 2A and/or housing part 2B. The lifting arm 23 is preferably arranged, at least in sections or predominantly, inside the housing 2A and/or housing part 2B or projects into it.

The housing 2A and/or housing part 2B preferably has a recess or breakthrough through which the actuating lever 21 or lifting arm 23 is or can be passed.

The actuating lever 21 is in particular shown in FIG. 5.

The actuating arm 22 is preferably designed for manual actuation by a user not shown.

The actuating arm 22 can be curved and/or bent and/or ergonomically shaped. This is conducive to an easy and comfortable operation.

The lifting arm 23 is preferably designed for driving the pumping device 4, in particular for actuation and/or compression of the bellows 5 and/or for axial movement of the base 9, in particular upwards and/or in the direction of the outlet 5B and/or dispensing head 14.

The lifting arm 23 is preferably arranged at an end section of the actuating arm 22, in particular so that the greatest possible leverage effect can be generated during actuation via the actuating arm 22.

In FIG. 2, the actuating lever 21 is shown in a first or unactuated swivel position and in FIG. 3 in a second or actuated swivel position. Preferably, the actuating lever 21 can be swiveled between the first or unactuated and the second or actuated swivel position.

The movement from the first to the second swivel position is preferably effected by manual actuation and/or swiveling of the actuating lever 21 by a user not shown.

Preferably, the base 9, in particular the bottom element 10, forms or has a counter surface or actuating surface for the actuating lever 21 and/or lifting arm 23. The actuating lever 21 and/or lifting arm 23 preferably abuts and/or acts on the bottom element 10 or the actuating surface formed thereby, in particular when swiveling from the first to the second swivel position, and/or exerts a force thereon.

By an actuation of the actuating lever 21 or the actuating arm 22, in particular by swiveling from the first to the second swivel position, preferably the bellows 5 is actuated and/or compressed and/or deformed or moved from the rest position to the compressed position. This is achieved in particular by the lifting arm 23 rotating about a swivel axis and/or a bearing part 24 during the actuation and/or swiveling movement, so that an end of the lifting arm 23 assigned to or facing the base 9 is lifted and/or moved in the direction of the bellows 5.

In particular, an actuation of the actuating lever 21 and/or swiveling of the actuating lever 21 from the first to the second swivel position thus causes a compression of the bellows 5 and/or a discharge of the fluid F.

Preferably, a movement of the actuating lever 21 from the second or actuated swivel position (back) to the first or unactuated swivel position is carried out automatically or no active movement or actuation of the actuating lever 21 is required for this. A movement from the second to the first swivel position can preferably be effected by a user releasing the actuating arm 22.

The expansion of the bellows 5 and/or the movement of the actuating lever 21 from the second to the first swivel position, which is in particular caused by the expansion, is preferably effected by the (elastic) restoring force caused by the previous elastic deformation and/or compression of the bellows 5. When the bellows 5 expands, preferably the base 9 and/or the bottom element 10 or the actuating surface formed thereby acts on the actuating lever 21 and/or lifting arm 23 and/or exerts a force on the actuating lever 21 and/or lifting arm 23, so that the actuating lever 21 is moved or swiveled from the second swivel position to the first swivel position.

Particularly preferably, the lifting arm 23 is formed by two elements 23A which run parallel to each other, the elements 23A in particular being of arm-like or bridge-like design, the elements 23A being connected to or arranged on the actuating arm 22 on one side and being rigidly connected to each other on the end side opposite the actuating arm 22 by a further element 23B which is arranged transversely or at right angles to the elements 23A. In this way, a lifting arm 23 is formed which is both stable and saves material. However, other solutions are also possible here.

Preferably, an, in particular a round or cylindrical, bearing part 24 is arranged and/or fastened between the elements 23A. The bearing part 24 preferably runs transversely, especially perpendicularly, between and/or to the elements 23A. The bearing part 24 is preferably formed in one piece with the lifting arm 23 and/or the actuating arm 22. For example, the actuating lever 21, the actuating arm 22 and/or the lifting arm 23 can be formed by a (one-piece) injection-moulded component. However, other solutions are also possible.

Preferably, the actuating lever 21 is pivotably mounted at the dispensing device 2, in particular the housing 2A and/or the connection part 20, by means of the bearing part 24.

The bearing part 24 preferably forms a rotation axis and/or swivel axis around which the actuating lever 21 can be swiveled or is swiveled when actuated.

Preferably, the dispensing device 2 and/or the connection part 20 has a bearing 25 for the bearing part 24 which is assigned to the bearing part 24 and/or is complementary to the bearing part 24. The bearing 25 is designed in particular for the preferably rotatable holding and/or bearing of the bearing part 24 and/or actuating lever 21. In particular, the bearing part 24 can be arranged or fastened in the bearing 25, preferably in a latching manner, in particular wherein the bearing 25 holds the bearing part 24 in a form-fitting manner and/or at least partially embraces it.

In principle, however, a swiveling bearing of the actuating lever 21 can also be carried out in a different way than described here.

In FIG. 1 to 3, the actuating lever 21 is shown in a position of use. The position of use is preferably the position and/or relative arrangement of actuating arm 22 and lifting arm 23 to each other in which an actuation of the actuating lever 22 for dispensing the fluid F takes place or can take place. In particular, the term "position of use" denotes a relative arrangement of the actuating arm 22 and the lifting arm 23 to each other, but not a pivoted position of the actuating lever 21.

Preferably, the lifting arm 23 and the actuating arm 22—at least in the position of use—are arranged transversely, in particular at least substantially perpendicular to each other.

According to an independently realizable aspect of the present invention, the actuating arm 22 can be folded away, in particular from the lifting arm 23, and/or the actuating arm 22 is movable relative to the lifting arm 23, in particular foldable or pivotable. This functionality is realized in particular in the exemplary embodiments shown in FIG. 6 to 8.

The actuating arm 22 can preferably be secured against actuation and/or in a securing position by folding away or down or up and/or on the dispensing head 14.

The actuating lever 21 and/or actuating arm 22 can preferably be arranged in a securing position and/or folded into a securing position, so that the actuating lever 21 is secured or can be secured against actuation in the securing position.

In FIG. 6 to 8, the actuating lever 21 is shown in the securing position and/or with the actuating arm 22 folded away. For securing the actuating lever 21 and/or actuating arm 22, different realizations are possible. FIG. 6 to 8 show two preferred embodiments which can also be combined with each other.

FIG. 6 shows a (second) exemplary embodiment in which the actuating arm 22 can be secured to the dispensing head 14 by positive locking. Preferably, the dispensing head 14 has a closure 26 for this purpose. The closure 26 is preferably implemented or designed separately or as a separate component from the dispensing head 14.

The closure 26 preferably forms a securing part or securing element for the actuating arm 22 and/or actuating lever 21.

Preferably, the closure 26 is connectable to the dispensing head 14 and/or separable or removable from the dispensing head 14.

Preferably, the closure 26 is held or arranged or can be arranged to the dispensing head 14 in a positive-locking and/or latching manner.

The closure 26 is preferably designed to (fluid-tightly) close or cover the outlet channel 15 and/or the outlet opening 16 and/or to secure or hold the actuating lever 21 and/or actuating arm 22 in the securing position, in particular by positive locking. In the position of the closure 26 shown in FIG. 6, the outlet channel 15 and/or the outlet opening 16 is closed and at the same time the actuating arm 22 is secured in the securing position and/or secured against actuation by positive locking.

Preferably, the closure 26, at least in the position shown in FIG. 6, forms a stop for the actuating arm 22, against which the actuating arm 22 rests in the securing position and by which any movement of the actuating arm 22, in particular into the position of use, is blocked.

Preferably, the closure 26 is movably arranged on and/or connected to the dispensing head 14 in such a way that the outlet channel 15 and/or the outlet opening 16 and/or the actuating arm 22 can be released or unlocked.

The actuating arm 22 is preferably released or unlocked by turning the closure 26 into a release position, in particular by at least substantially about 90° from the closed position of the closure 26 shown in FIG. 6.

The release position of the closure 26 is shown in FIG. 7.

The closure 26 is preferably elongated, so that by a rotation from the closed position to the release position and/or by about 90° from the closed position, the positive locking and/or blocking of the actuating arm 22 is released and/or the closure is swiveled away from the actuating arm 22.

With a further rotation by at least substantially about 90° from the release position and/or by at least substantially about 180° from the closed position, preferably the outlet channel and/or the outlet opening 16 is uncovered for fluid dispensing. In this uncovering position, the outlet opening 16 and/or the outlet channel 15 preferably opens into a dispensing opening 28 of the closure 26 and/or the dispensing opening 28 is fluidically connected with the outlet channel 15. In the uncovering position, the dispensing opening 28 preferably forms an extension or part of the outlet channel 15.

The discharge opening 28 and/or outlet opening 16 can be designed as a nozzle or nozzle-like and/or be designed in such a way that a desired discharge form of the fluid F is achieved or effected through the discharge opening 28 and/or outlet opening 16 or their shape, for example as a spray or aerosol or foam.

The closure 26 can preferably be arranged on a connecting element 27 of the dispensing head 14 and/or connected to the connecting element 27, in particular by plugging or pushing it onto the connecting element 27. Preferably, the closure 26 is held, in particular movably or rotatably, in a positive-locking and/or latching manner on the connecting element 27.

The connecting element 27 is preferably designed as a part protruding from the closure 26 or an end face 26A of the closure 26. Preferably, the connecting element 27 has an elongated, in particular cylindrical, section 27A arranged on the end face 26A. At the end facing away from the end face 26A, the connecting element 27A or the section 27A preferably has a head 27B, which is in particular widened with respect to the section 27A and/or projects radially beyond the section 27A, so that the closure can be arranged on the connecting element 27 or the head 27B in a positive-locking or latching manner or can be connected thereto.

The closure 26 is preferably rotatable about the connecting element 27, in particular in such a way that the connecting element 27 has or forms an axis of rotation D for the closure 26. The axis of rotation D is preferably transverse, in particular perpendicular, to the axis L.

Deviating from the illustration in FIG. 6, it is also possible that the actuating arm 22 is securable by or with the closure 26. In this embodiment not shown in the figures, the actuating arm 22 and the closure 26 can have elements that are assigned to each other and/or complementary to each other to create a latching connection, e.g. latching cams or the like.

In particular, it may be provided that the latching connection between the actuating arm 22 and the closure 26—in contrast to the embodiment shown in FIG. 6—is provided and/or made on the side facing away from the dispensing head 14, i.e. on the left side of the closure 26 in FIG. 6.

In a further variant not shown in the figures, the actuating lever 21 and/or actuating arm 22 is arrangeable in a securing position or securable at the dispensing head 14 without the additional or separately manufactured closure 26.

In this variant, the dispensing head 14 preferably has or forms a stop or shoulder 14C, in particular in the area of the outlet opening 16 and/or at an end. The shoulder 14C can in particular be designed similarly or at least essentially as the shoulder 14C indicated in FIG. 6.

The free end of the actuating arm 22 can preferably be secured by the shoulder 14C and/or positively locked and/or clamped behind the shoulder 14C—similar to the embodiment with the closure 26 shown in FIG. 6. The length of the actuating arm 22 is preferably selected or adapted accordingly, so that the free end can be positively secured by the shoulder 14C.

Preferably, the actuating arm 22 and/or the shoulder 14C are designed to be flexible and/or deformable in such a way that the actuating arm 22 can be moved past the shoulder 14C from the securing position with a slight, increased amount of force, preferably wherein the shoulder 14C and/or the actuating arm 22 are slightly deformed and thus enable the movement or release.

FIG. 8 shows a third version or a further variant for securing the actuating arm 22 at the dispensing head 14 and/or closing the outlet channel 15 or the outlet opening 16 by the actuating lever 21 and/or actuating arm 22.

In order to explain the (third) embodiment shown in FIG. 8, the following only deals with the differences to the (second) embodiment shown in FIGS. 6 and 7. A repeated explanation or explanation of the same or similar characteristics is not given, wherein the previous explanations shall preferably also apply to FIG. 8, unless explicitly stated otherwise.

In the exemplary embodiment shown in FIG. 8, the dispensing head 14 preferably has no additional closure 26 or the additional closure 26 can be dispensed with.

Preferably, the actuating lever 21 and/or actuating arm 22 or one end 22A thereof is designed directly to close or seal the outlet channel 15 and/or the outlet opening 16.

Preferably, the end 22A of the actuating arm 22 can be arranged at and/or fastened to the dispensing head 14, in particular it can be put and/or pushed over the outlet opening 16.

To achieve this, the end 22A of the actuating lever 21 and/or actuating arm 22 assigned to the outlet opening 16 is preferably designed like a sleeve and/or has a sleeve for covering and/or closing the outlet opening 16 or the outlet channel 15.

Preferably, also in the exemplary embodiment in FIG. 8, the actuating lever 21 and/or actuating arm 22 is secured and/or fastened in the securing position and/or on the dispensing head 14 by positive locking and/or latching. For this purpose, elements not shown in FIG. 8 may be arranged between the actuating arm 22 and the dispensing head 14 to create a latching connection, or the actuating arm 22 and the dispensing head 14 may have correspondingly assigned or complementary elements, e.g. latching cams or the like.

The following explanations preferably refer again to all embodiments shown in the figures.

The actuating arm 22 and the lifting arm 23 are preferably movable relative to each other, especially pivotable. As already explained above, the actuating arm 22 is in particular foldable down from the lifting arm 23.

By means of the folding movement, the actuating arm 22 and/or actuating lever 21 can preferably be positioned alternatively in an position of use shown in FIG. 1 to 5 and in a securing position shown in FIG. 6 to 8.

Preferably, the actuating arm 22 is connected to the lifting arm 23 by a flexure bearing or film hinge 29.

The film hinge 29 is preferably made of the same material as the lifting arm 23 and/or the actuating arm 22, in particular of plastic.

The film hinge 29 is preferably flexible and/or deformable, in particular due to a correspondingly low thickness or material thickness.

The actuating lever 21 is preferably securable or arrangeable in the position of use by positive locking and/or latching. Preferably, the actuating arm 22 and the lifting arm 23 have a latching connection and/or respective and/or corresponding latching elements 30 for this purpose, which interlock or latch into each other in the position of use and/or hold or secure or fix the actuating arm 22 in the position of use on the lifting arm 23.

Preferably, the latching connection and/or the latching elements 30 are designed in such a way that when the actuating arm 22 is moved from the securing position to the position of use, the latching connection is automatically established and/or the latching elements 30 are automatically connected to each other and/or latch into each other at the end of the movement.

The latching connection or the latching elements 30 may be designed in such a way that after a first or single movement of the actuating arm 22 (from the securing position) into the position of use or after a first or single connection, they can no longer be separated from each other or can only be separated with great force and/or by damaging the actuating lever 21.

However, it may also be provided that the latching connection can be released or separated again so that the actuating lever 21 can be secured again and/or the actuating arm 22 can be moved repeatedly from the securing position to the position of use and secured in the respective position or vice versa.

In a further variant not shown, the movement or folding of the actuating arm 22 from the position of use to the securing position may be limited and/or after a certain movement path or folding or pivoting angle, further movement may be blocked, especially if the actuating arm 22 has reached the securing position. Preferably, any movement of the actuating arm 22 beyond the securing position is blocked, in particular by positive locking.

For example, a movement of the actuating arm 22 beyond the securing position may be blocked by an end section or area of the actuating arm 22—in particular the upper section of the actuating arm 22 in the figures—coming to rest against the lifting arm 23 or its upper side in the securing position or any other end position, thus blocking further movement or pivoting. For this purpose, the actuating arm 22 and/or the lifting arm 23 may also have appropriately shaped projections, shoulders, stops or other suitable sections, areas or parts.

It may be provided that the actuating arm 22 and/or actuating lever 21 (additionally) is securable against unintentional actuation and/or in the securing position by the actuating arm 22 (in the securing position) engaging on the lifting arm 23. Preferably, the actuating arm 22 and/or the lifting arm 23 have corresponding latching elements for this purpose. The latching connection thus formed can preferably be released again.

In the following, in particular a fourth embodiment of the present invention is explained on the basis of FIGS. 9 and 10. In particular, differences to the first, second and third embodiments are explained. Provided that no deviations or differences between the embodiments are explained, the above explanations preferably also apply to the fourth embodiment described below.

In contrast to the embodiments explained above, the dispensing device 2 according to the fourth design has a blocking element 31, in particular in addition to the other parts and components already described above.

The blocking element 31 is preferably designed to be movable. In particular, the blocking element 31 is movable and/or arranged movably relative to the actuating lever 21 and/or actuating arm 22 and/or relative to the housing 2A.

Preferably, the actuating lever 21 is not rotatable relative to the housing 2A or around the axis L.

Preferably, the actuating lever 21 or actuating arm 22 has the blocking element 31. The blocking element 31 is preferably arranged and/or fastened at the actuating lever 21, in particular the actuating arm 22, in particular on a side facing the housing 2A. In principle, however, it is also possible to arrange or fasten the blocking element 31 at the housing 2A. In this case, the following explanations apply in reverse.

Preferably, the blocking element 31 is arranged on the actuating lever 21 and/or actuating arm 22 so as to be pivotable or tiltable relative to the actuating lever 21 and/or actuating arm 22, in particular by means of a flexible and/or articulated connecting piece 32. The connecting piece 32 may be formed by a film hinge or the like, for example.

The blocking element 31 is preferably elongated and/or bar-shaped.

In FIG. 9, the actuating lever 21 is shown in a secured or blocked position or blocking position. The terms "blocked position" and "blocking position" are used synonymously.

In the blocked position, the blocking element 31 is preferably arranged between the actuating lever 21 and/or actuating arm 22 and the housing 2A, in particular housing part 2B, in particular transversely to the housing 2A, in particular housing part 2B, and/or the actuating arm 22. Preferably, in the blocked position, the blocking element 31 rests against the housing 2A and/or, in the blocked position, the blocking element 31 is clamped between the actuating arm 22 and the housing 2A and/or housing part 2B.

The blocking element 31 is preferably flexible and/or elastic.

Preferably, the blocking element 31 is elastically deformed in the blocked position and/or the blocking element 31 is under tension, in particular compressive stress, in the blocked position, so that the actuating lever 21 and/or actuating arm 22 is reliably blocked against actuation and/or is forced and/or pretensioned into the blocked position.

The blocking element 31 can preferably be clamped on several sides, in particular between the actuating lever 21 and/or actuating arm 22 and the housing 2A and/or housing part 2B.

The blocking element 31 is preferably bent. This enables and/or facilitates tension or pretension in a defined direction.

In particular, the blocking element 31 is arranged and/or fixed in the blocked position between the housing 2A and/or housing part 2B and the actuating arm 22, so that the actuating arm 22 cannot be moved out of the blocked position and/or is blocked against actuation.

To fix the blocking element 31, the housing 2A and/or housing part 2B can have a fixing device 33. The fixing device 33 preferably has or consists of one or more latching elements, so that the blocking element 31, in particular a free end of the blocking element 31 and/or an end on a side of the blocking element 31 facing away from the connecting piece 32, can be latched into the fixing device 33 and thus fixed.

The fixing device 33 is in particular designed for the releasable fixing or fastening of the blocking element 31. Preferably, the blocking element 31 is not damaged when it is released from the fixing device 33. The blocking element 31 is preferably reusable and/or can be arranged and/or fixed in the fixing device 33 again after it has been released from the fixing device 33.

In the blocked position, the actuating lever 21 and/or actuating arm 22 is preferably swivelled away from the housing 2A or housing part 2B and/or is held and/or fixed by the blocking element 31 in a position swivelled away from the housing 2A and/or housing part 2B.

In the blocked position, the actuating lever 21 and/or lifting arm 23 preferably rests on the connection part 20 and/or an upper section of the guide 18. In this way, the actuating lever 21 is secured in two directions against movement out of the blocked position.

Preferably, the blocking element 31 can be swivelled or folded from the blocked position and/or into a second position or moved into the second position in some other way. The second position of the blocking element 31 is shown in FIG. 10.

The blocking element 31 can be released from the fixing device 33 and/or moved into the second position preferably by applying a force transverse to the main direction of extension of the blocking element 31.

In the second position, the blocking element 31 is preferably arranged in such a way that the actuating lever 21 and/or the dispensing device 2 can be actuated freely, in particular without restricting or hindering an actuation by the blocking element 31. In the second position, the actuating lever 21 and/or actuating arm 22 is preferably released.

In the second position, the blocking element 31 preferably rests on the actuating arm 22 and/or is embedded in the actuating arm 22. In particular, the blocking element 31 can be folded up against the actuating arm 22 and/or, in the second position, is folded up against the actuating arm 22 and/or can be folded into the actuating arm 22 or, in the second position, is folded into the actuating arm 22. Particularly preferably, the blocking element 31 does not protrude from the actuating arm 22 in the second position.

Preferably, the blocking element 31 can be folded down from the actuating arm 22 and/or folded out of the actuating arm 22. In particular, this allows the actuating lever 21 and/or actuating arm 22 to be secured or blocked again.

The actuating lever 21 and/or actuating arm 22 preferably has a fixing device 34 for fixing the blocking element 31 in the second position. The fixing device 34 of the actuating lever 21 is preferably similar or identical to the fixing device 33 of the housing 2A. The above statements on the fixing device 33 of the housing 2A therefore preferably apply accordingly to the fixing device 34 of the actuating lever 21.

Individual aspects and features of the present invention, in particular the various embodiments, may be realizable and advantageous individually and in any combination.

LIST OF REFERENCE NUMBERS

1 Dispenser
2 Dispensing device
2A Housing
2B Housing part
3 Container
4 Pumping device
5 Bellows
5A Inlet
5B Outlet
5C Interior
5D Fastening section
6 Side wall
7 Inlet valve
7A Valve element
7B Arm
8 Outlet valve
8A Sealing lip
8B Counter surface
9 Base
10 Bottom element
10A Ring section
11 Supply channel
11A Opening
12 Conduit
13 Riser
14 Dispensing head
14A Fastening part
14B Breakthrough

14C Shoulder
15 Outlet channel
16 Outlet opening
17 Ventilation gap
18 Guide
18A Stop
19 Taper
20 Connection part
21 Actuating lever
22 Actuating arm
22A End
23 Lifting arm
23A Element
23B Element
24 Bearing part
25 Bearing
26 Closure
27 Connecting element
27A Section
27B Head
28 Dispensing opening
29 Film hinge
30 Latching elements
31 Blocking element
32 Connecting piece
33 Fixing device (housing)
34 Fixing device (actuating lever)
D Axis of rotation
F Fluid
L Axis

The invention claimed is:

1. A dispensing device configured to dispense a fluid, comprising:

a pumping device with a flexible bellows to convey the fluid and an actuating lever to actuate the pumping device, wherein the pumping device has a base connected to the bellows on the inlet side and having a supply channel for the fluid, the base being a component which is separately manufactured from the bellows, wherein the base has a bottom element and a conduit forming or limiting the supply channel, the conduit and the bottom element being integrally formed, and wherein the bottom element forms or has a counter surface for the actuating lever, and a dispensing head with an outlet channel having an outlet opening and a rotatable element connected to the dispensing head, wherein the axis of rotation of the rotatable element runs parallel to and spaced apart from the outlet channel, wherein the rotatable element comprises a discharge opening positioned eccentrically with respect to the axis of rotation, and wherein the rotatable element us rotatable to at least one of: cover the outlet opening such that discharge of the fluid is disabled or align the outlet opening and discharge opening such that discharging of the fluid is enabled.

2. The dispensing device according to claim 1, wherein at least one of the base is movable axially by actuating the actuating lever and the bellows is conipressable by actuating the actuation lever, wherein the actuating lever abuts on the bottom element or the counter surface formed thereby and acts or exerts a force thereon.

3. The dispensing device according to claim 1, wherein the actuating lever is pivotably arranged or mounted on the dispensing device.

4. The dispensing device according to claim 1, wherein the actuating lever has a manually actuatable actuating arm and a lifting arm to drive the pumping device coupled thereto.

5. The dispensing device according to claim 1, wherein the conduit is sealingly held in a guide and has a taper on the outside, so that the conduit is lifted off and a ventilation gap to ventilate a container is thus formed between the guide and the conduit when at least one of: the dispensing device is actuated or an axial movement takes place.

6. The dispensing device according to claim 1, wherein the dispensing device has an inlet valve with a valve element for sealingly covering an end-side opening of the supply channel, the valve element being formed in one piece with the bellows and being held by one or more flexible arms of the bellows.

7. The dispensing device according to claim 6, wherein the arms are curved and run at their ends at least substantially radially and in a section spaced from the ends in the shape of an arc of a circle and/or parallel to the outer contour of the valve element.

8. The dispensing device according to claim 1, with the bottom element at least one of being plate-like, being circular disc-shaped or forming an annular surface.

9. The dispensing device according to claim 1, wherein the bellows has a fastening section which is connected to the base in a non-positive or frictional manner or by at least one of latching, gluing or welding to the base.

10. The dispensing device according to claim 1, wherein the bellows has a fastening section and the bottom element has a ring section, complementary to the fastening section, wherein the fastening section is fastened to or connected to the ring section.

11. The dispensing device according to claim 1, wherein the actuating lever is securable against actuation by a movable blocking element, wherein the blocking element is movable into a blocking position in which it blocks the actuating lever against undesired actuation.

12. The dispensing device according to claim 11, wherein the blocking element is pivotable relative to the actuating lever.

13. The dispensing device according to claim 11, wherein the blocking element is arranged on the actuating lever by a flexible or hinged connector which is formed by a film hinge.

14. The dispensing device according to claim 11, wherein in the blocking position the actuating lever is held or blocked in a position swivelled away from the housing by the blocking element.

15. The dispensing device according to claim 1, wherein the dispensing device has a connection part or housing to attach the dispensing device to a container, wherein the actuating lever is pivotably mounted on the connection part or housing with the pivot axis located at the connection part.

16. The dispensing device according to claim 15, wherein the actuating lever has a manually actuatable actuating arm and a lifting arm to drive the pumping device coupled thereto, wherein the lifting arm comprises a bearing part which is pivotably mounted on a corresponding bearing of the connection part.

17. A dispensing device configured to dispense a fluid, comprising:

a dispensing head with an outlet channel having an outlet opening, a rotatable element connected to the dispensing head, wherein the axis of rotation of the rotatable element runs approximately parallel to and spaced apart from the outlet channel, wherein the rotatable element comprises a discharge opening positioned eccentrically with respect to the axis of rotation, and wherein the rotatable element is rotatable to at least one of: cover the outlet opening such that discharge of the fluid is disabled or align the outlet opening and discharge opening such that discharging of the fluid is enabled.

18. The dispensing device of claim 17, wherein the discharge opening is formed to effect the discharge form of the fluid to be a spray, aerosol or foam.

* * * * *